US007478807B2

(12) United States Patent
Detloff et al.

(10) Patent No.: US 7,478,807 B2
(45) Date of Patent: Jan. 20, 2009

(54) METHOD FOR CONVEYING A SHEET AND APPARATUS FOR CARRYING OUT THE METHOD

(75) Inventors: Andreas Detloff, Walldorf (DE); Bernhard Falk, Pfungstadt (DE); Michael Füner, Karlsruhe (DE); Peter Hachmann, Dossenheim (DE); Johann Schunn, Leimen (DE); Peter Thoma, Mannheim (DE)

(73) Assignee: Heidelberger Druckmaschinen AG, Heidelberg (DE)

( * ) Notice: Subject to any disclaimer, the term of this patent is extended or adjusted under 35 U.S.C. 154(b) by 140 days.

(21) Appl. No.: 11/504,748

(22) Filed: Aug. 15, 2006

(65) Prior Publication Data

US 2007/0063428 A1 Mar. 22, 2007

(30) Foreign Application Priority Data

Sep. 21, 2005 (DE) ..... 10 2005 044 995

(51) Int. Cl.
*B65H 31/00* (2006.01)

(52) U.S. Cl. ..... 271/208; 271/193; 271/204

(58) Field of Classification Search ..... 271/310, 271/309, 176, 193, 195, 208; 101/232
See application file for complete search history.

(56) References Cited

U.S. PATENT DOCUMENTS

| | | | | |
|---|---|---|---|---|
| 1,680,310 | A | 8/1928 | Wehrle | |
| 3,754,830 | A * | 8/1973 | Phillips et al. | 356/340 |
| 4,263,636 | A | 4/1981 | Testone | |
| 4,930,414 | A * | 6/1990 | Wirz | 101/183 |
| 4,949,950 | A * | 8/1990 | Stephany | 271/193 |
| 5,019,871 | A * | 5/1991 | Takeda et al. | 399/66 |
| 5,228,373 | A * | 7/1993 | Welsch | 83/24 |
| 5,634,636 | A * | 6/1997 | Jackson et al. | 271/225 |
| 5,787,810 | A * | 8/1998 | Stephan | 101/232 |
| 6,644,195 | B2 | 11/2003 | Stephan | |
| 7,059,598 | B2 * | 6/2006 | Hagemann et al. | 271/183 |
| 7,328,899 | B2 * | 2/2008 | Wulf et al. | 271/276 |
| 2001/0018871 | A1 | 9/2001 | Henn | |
| 2004/0074410 | A1 | 4/2004 | Domes | |

FOREIGN PATENT DOCUMENTS

| | | | |
|---|---|---|---|
| DE | 2 242 946 | | 3/1974 |
| DE | 43 36 479 | A1 | 4/1995 |
| DE | 195 36 248 | A1 | 4/1997 |
| DE | 197 30 042 | A1 | 1/1999 |
| DE | 100 03 352 | A1 | 8/2001 |
| DE | 199 38 600 | A1 | 8/2001 |
| DE | 10 2004 011 114 | A1 | 10/2004 |
| EP | 1 114 720 | A2 | 7/2001 |
| EP | 1 155 834 | A2 | 11/2001 |

* cited by examiner

*Primary Examiner*—Patrick H Mackey
*Assistant Examiner*—Luis Gonzalez
(74) *Attorney, Agent, or Firm*—Laurence A. Greenberg; Werner H. Stemer; Ralph E. Locher

(57) ABSTRACT

A method for conveying a sheet includes guiding an electrically charged sheet pneumatically along a desired path, continuously detecting a charge distribution on the sheet, and reducing a positional deviation of the sheet from the desired path by actuating at least one actuating element influencing the position in dependence on the charge distribution. An apparatus for conveying a sheet includes a control device for the position of the sheet and a sensor connected to the control device for detecting an electric field present on the sheet. The method and apparatus permit the sheet to be guided with small deviations from the desired path.

7 Claims, 2 Drawing Sheets

METHOD FOR CONVEYING A SHEET AND APPARATUS FOR CARRYING OUT THE METHOD

BACKGROUND OF THE INVENTION

Field of the Invention

The invention relates to a method for conveying a sheet, in which an electrically charged sheet is guided pneumatically along a desired path. The invention also relates to an apparatus for carrying out the method.

German Published, Non-Prosecuted Patent Application DE 43 36 479 A1 discloses a control device for the transport of workpieces in a printing machine. The control device includes an electrification configuration for the workpieces and a configuration for measuring field strength. Changes in the field strength occurring as a workpiece edge passes through are detected and used in generating actuating signals for a sheet transport apparatus.

According to German Published, Non-Prosecuted Patent Application DE 22 42 948 A1, corresponding to U.S. Pat. No. 3,868,666, a stream of ions is led through a transport path in order to detect sheet material which is transported wrongly. The stream of ions is interrupted when a sheet is conveyed past. A switch of a sheet-processing machine is controlled on the basis of the magnitude of the stream of ions.

German Published, Non-Prosecuted Patent Application DE 199 38 600 A1 discloses a device for processing a material web, in which electrostatic charging of the material web is detected by a sensor and the charge is dissipated through the use of a discharging rod on the basis of the sensor signal. The discharging rod is connected to a controllable high voltage source. The device can be used only at low transport speeds.

According to German Published, Non-Prosecuted Patent Application DE 195 36 248 A1, a linear configuration of discharging points is used for the purpose of passive discharging of a statically charged recording medium in a printing device. The discharging points are disposed at a distance from the recording medium being conveyed past.

According to German Published, Non-Prosecuted Patent Application DE 197 30 042 A1, an actual position of a sheet is detected by a distance sensor measuring without contact and is compared with a reference position, in an apparatus for regulating a blown air rate in a sheet-fed printing machine in a region of sheet guidance. Reference-actual deviations of the position are compensated for by driving actuating elements for the blown air rate. The distance sensor proposed is an optical triangulation sensor or an ultrasonic distance sensor. The influence of static electricity on the position of the sheets is not taken into account directly.

SUMMARY OF THE INVENTION

It is accordingly an object of the invention to provide a method for conveying a sheet and an apparatus for carrying out the method, which overcome the hereinafore-mentioned disadvantages of the heretofore-known methods and apparatuses of this general type and which permit a sheet to be guided with small deviations from a desired path.

With the foregoing and other objects in view there is provided, in accordance with the invention, a method for conveying a sheet. The method comprises pneumatically guiding an electrically charged sheet along a desired path, continuously detecting a charge distribution on the sheet, and reducing a deviation in a position of the sheet from a desired path by actuating at least one actuating element influencing the position in dependence on a charge distribution.

With the objects of the invention in view, there is also provided an apparatus for carrying out the method. The apparatus comprises a control device for controlling the position of the sheet, and a sensor connected to the control device for detecting the electric field present on the sheet.

Therefore, according to the invention, a charge distribution on a sheet is detected continuously by a sensor. In order to reduce the positional deviation of the sheet from a desired path, at least one actuating element influencing the position is actuated on the basis of the charge distribution.

In accordance with another feature of the invention, the actuating element is a configuration forming ions, such as a rod forming corona ions. Furthermore, a blown air and/or vacuum device can be used as the actuating element.

In accordance with a further feature of the invention, the sheet is held in grippers on a revolving drum, a sheet guide plate and a blown air device are disposed along a circumferential contour of the drum, and a sensor for detecting an electric field present on the sheet is integrated into the sheet guide plate. The floating height of the sheet above the guide plate can be controlled or regulated with an additional distance sensor.

In accordance with a concomitant feature of the invention, the sensor used to detect the electric charge present on the sheet is an electric field meter or a sensor for a variable proportional to the electric charge, in particular paper moisture.

Other features which are considered as characteristic for the invention are set forth in the appended claims.

Although the invention is illustrated and described herein as embodied in a method for conveying a sheet and an apparatus for carrying out the method, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

Figure 1:
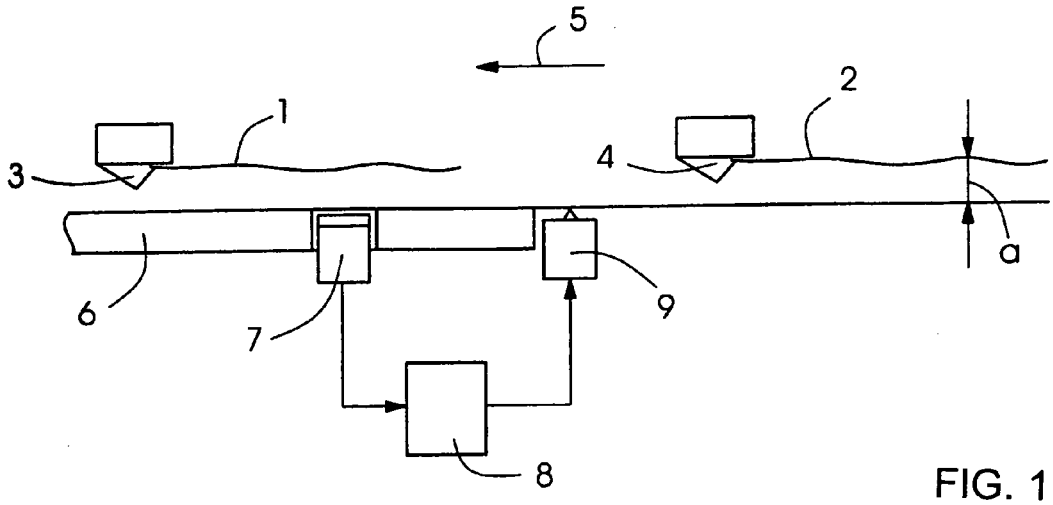
FIG. 1 is a diagrammatic, side-elevational view of an apparatus for conveying sheets having a rod forming corona ions.

Referring now to the figures of the drawings in detail and first, particularly, to FIG. 1 thereof, there is seen a diagrammatic illustration of an apparatus for conveying sheets 1, 2, which are held only at the leading edge in grippers 3, 4 of a chain gripper system and are transported onto a stack in a direction 5. The sheets 1, 2 are conveyed along a sheet guide plate 6 with a desired average spacing a therebetween. The sheets 1, 2 have an electric charge on the surface, so that they are kept at a distance from the sheet guide plate 6 by electrostatic repulsion forces as they are conveyed. The distance of the sheets from the sheet guide plate 6 depends on the electric field strength between the sheets 1, 2 and a mating electrode in a fixed location, such as the sheet guide plate 6. The field strength which is required results from sheet properties, such as sheet format, sheet thickness and sheet moisture. The sheet guide plate 6 has a cutout formed therein, in which an electric field meter 7 is fixed flush with the surface of the guide plate. The actual charge of the sheets 1, 2 is measured by the electric field meter 7. Signals from the electric field meter 7 are evaluated in a control device 8. A rod 9 forming corona ions is connected to the control device 8 and is disposed upstream of the electric field meter 7 in a sheet run. A controllable high voltage source is disposed in the control device 8. If the actual charge is too low or too high, a distance a will be established which is smaller or greater than a desired distance a. The charge is increased or reduced by the rod 9 reaching over the sheet width by driving the high voltage source, in such a way that the desired distance a is established.

If designations which have already been used are used in the following description, they are elements or symbols with an equivalent function or equivalent meaning.

Figure 2:
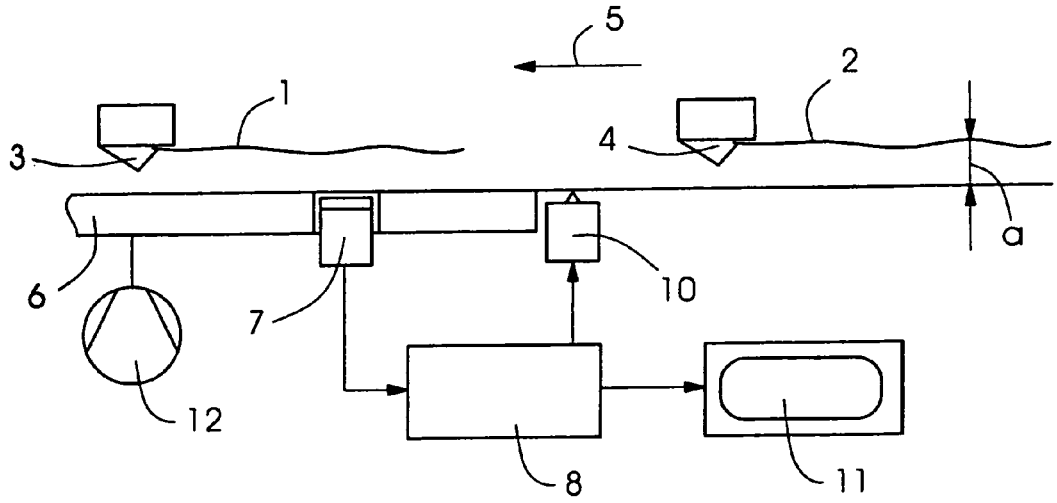
FIG. 2 is a side-elevational view of an apparatus for conveying sheets with control of a blown air rate of a blown air device.

In the apparatus according to FIG. 2, sheets 1, 2 are conveyed by grippers 3, 4 in a direction 5 along a sheet guide plate 6 at a desired distance a. A discharging rod 10 is disposed in the conveying path of the sheets 1, 2. Electric charges on the sheets 1, 2 running past are reduced or eliminated in each case by using the discharging rod 10. Integrated into the sheet guide plate 6 is an electric field meter 7, with which a residual charge of the sheets 1, 2 is detected or registered. Signals from the electric field meter 7 are processed in a control device 8. A field strength value, which is a measure of the residual charge, is displayed to an operator on a monitor 11 connected to the control device 8. Since a residual charge exerts a force on the respective sheet 1, 2, the sheet 1, 2 is not located at the desired floating height a above the sheet guide plate 6. The operator has the ability to compensate for the charge-induced force on the sheets 1, 2 with pneumatic forces by setting a blown air device 12.

Figure 3:
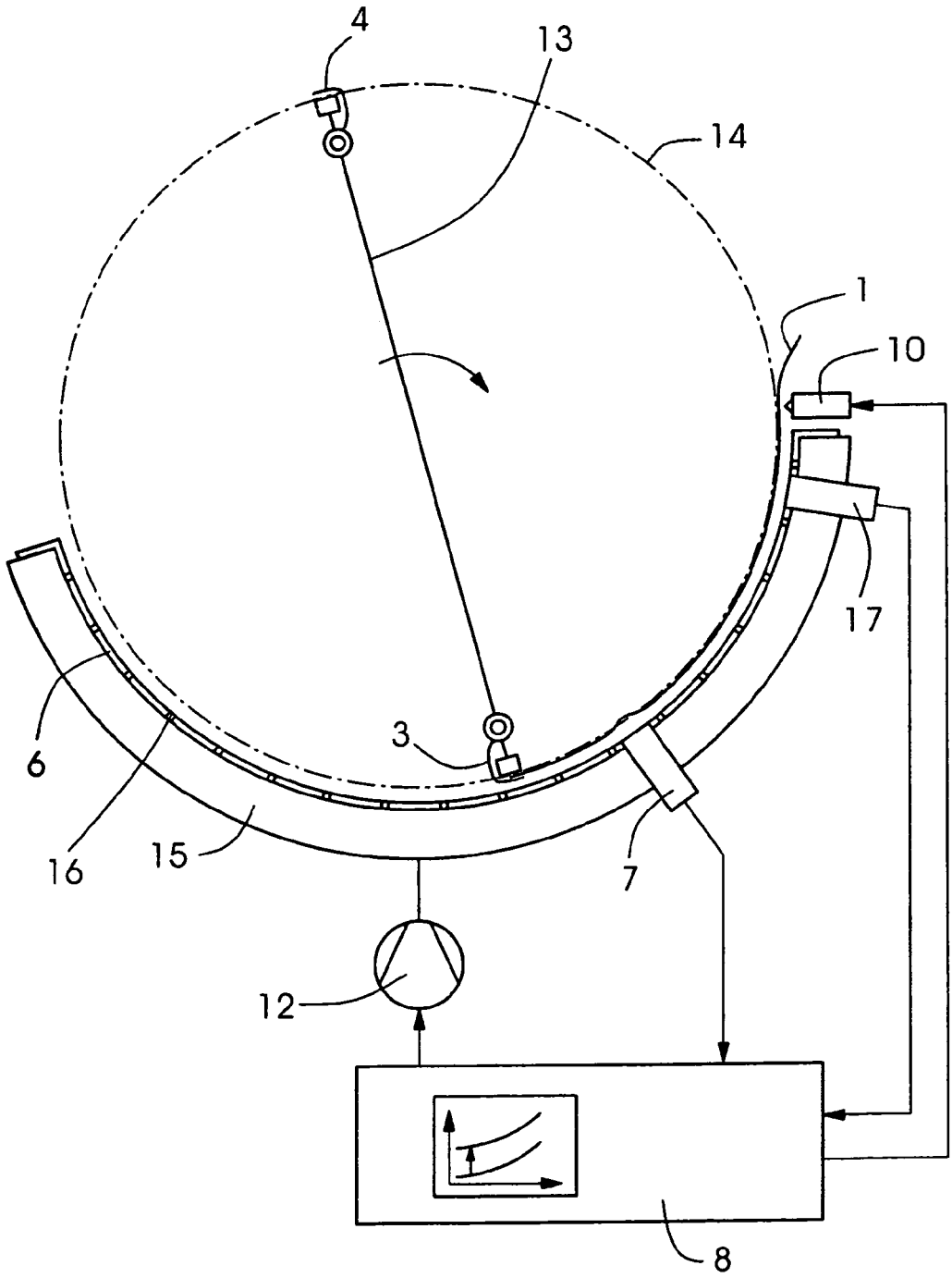
FIG. 3 is a side-elevational view of an apparatus for conveying sheets having a transport drum along a sheet guide plate.

FIG. 3 shows an embodiment in which a sheet 1 is conveyed by a transport drum 13. The sheet 1 is held at its leading edge by a gripper 3, 4 and is otherwise guided freely on a carrying air cushion. A sheet guide plate 6 is disposed along a circumferential contour 14 of the transport drum 13. A blower box 15 is situated under the sheet guide plate 6. The sheet guide plate 6 has a large number of blown air nozzles 16. The blower box 15 is connected to a blown air source 12. An electric field meter 7 and a distance sensor 17 are integrated into the sheet guide plate 6. A discharging rod 10 is disposed above the sheet guide plate 6, in an entry region of the sheet 1 into the carrying air cushion. The floating height of the sheet 1 above the sheet guide plate 6 is measured continuously by the distance sensor 17. Measured values from the distance sensor 17 are processed in a control device 8. If the floating height deviates from a desired value, an actuating signal for the blown air source 12 is formed in the control device 8, so that the desired-actual deviation is reduced. In the case of a conveyance through a printing machine, the sheet 1 has an electrostatic charge, which is neutralized or reduced by the discharging rod 10.

If the sheet 1 has a residual charge after the discharging rod 10, then the sheet 1 could come into contact with the metallic surface of the sheet guide plate 6 as a result of electrostatic forces, and a printed image located thereon could be damaged. The residual charge can be measured with the electric field meter 7. The output signals from the electric field meter 7 are supplied to the control device 8. An opposing force which is required in order to bring the sheet 1 onto the desired path is determined in the control device 8 from the electric field meter signals with the aid of characteristic curves which contain a relationship between field strength and grammage of the sheet 1. The opposing force is applied by driving the blown air source 12 in such a way that the carrying air cushion keeps the sheet 1 on the desired path.

This application claims the priority, under 35 U.S.C. §119, of German Patent Application DE 10 2005 044 995.6, filed Sep. 21, 2005; the prior application is herewith incorporated by reference in its entirety.

We claim:

1. A method for conveying a sheet, which comprises the following steps:

providing an apparatus for conveying a sheet, the apparatus including:

a desired path for a pneumatically guided, electrically charged sheet;

a sensor for continuously detecting a charge distribution of an electric field present on the sheet;

at least one actuating element for influencing a position of the sheet;

a control device connected to the sensor and to the at least one actuating element for actuating the at least one actuating element in dependence on the charge distribution to reduce a deviation in the position of the sheet from the desired path;

a revolving drum having a circumferential contour;

grippers disposed on the revolving drum for holding the sheet;

a sheet guide plate disposed along the circumferential contour of the drum and defining the desired path, the sensor being structurally combined with the sheet guide plate;

a blown air device forming the at least one actuating element and being disposed along the circumferential contour of the drum; and another sensor disposed along the circumferential contour for sensing a floating height of the sheet above the guide plate;

pneumatically guiding the electrically charged sheet along the desired path;

continuously detecting the charge distribution on the sheet; and reducing the deviation in a position of the sheet from the desired path by actuating the at least one actuating element influencing the position in dependence on the charge distribution.

2. An apparatus for conveying a sheet, the apparatus comprising:

a desired path for a pneumatically guided, electrically charged sheet;

a sensor for continuously detecting a charge distribution of an electric field present on the sheet;

at least one actuating element for influencing a position of the sheet;

a control device connected to said sensor and to said at least one actuating element for actuating said at least one actuating element in dependence on said charge distribution to reduce a deviation in said position of the sheet from said desired path;

a revolving drum having a circumferential contour;

grippers disposed on said revolving drum for holding the sheet;

a sheet guide plate disposed along said circumferential contour of said drum and defining said desired path, said sensor being structurally combined with said sheet guide plate;

a blown air device forming said at least one actuating element and being disposed along said circumferential contour of said drum; and another sensor disposed along said circumferential contour for sensing a floating height of the sheet above said guide plate.

3. The apparatus according to claim 2, further comprising another actuating element for influencing said position of the sheet, said other actuating element being a configuration influencing a charge of the sheet.

4. The apparatus according to claim 3, wherein said configuration contains a device forming ions.

5. The apparatus according to claim 4, wherein said configuration contains a rod forming corona ions.

6. The apparatus according to claim 5, wherein said sensor is an electric field meter, and said rod is disposed upstream of said electric field meter in a sheet run.

7. The apparatus according to claim 2, wherein said sensor is an electric field meter, and said blown air device is disposed downstream of said electric field meter in a sheet run.

* * * * *